United States Patent [19]

Ernst et al.

[11] Patent Number: 4,679,127

[45] Date of Patent: Jul. 7, 1987

[54] HEADLIGHT FOR MOTOR VEHICLES

[75] Inventors: Hans-Otto Ernst, Lippstadt; Helmut Jakobsmeyer, Paderborn-Elsen, both of Fed. Rep. of Germany

[73] Assignee: Hella KG Hueck & Co., Lippstadt, Fed. Rep. of Germany

[21] Appl. No.: 910,397

[22] Filed: Sep. 22, 1986

[30] Foreign Application Priority Data

Nov. 13, 1985 [DE] Fed. Rep. of Germany ..... 3540130

[51] Int. Cl.[4] ..... F21V 29/00

[52] U.S. Cl. ..... 362/294; 362/296; 362/303; 362/345; 313/113

[58] Field of Search ..... 362/303, 306, 343, 344, 362/61, 294; 313/115, 117, 113

[56] References Cited

U.S. PATENT DOCUMENTS

| | | | |
|---|---|---|---|
| 3,553,520 | 1/1971 | Hicks | 362/296 |
| 3,962,596 | 6/1976 | Draper | 313/117 |
| 4,029,985 | 6/1977 | Rachel | 313/117 |
| 4,280,173 | 7/1981 | Bradley et al. | 362/296 |

FOREIGN PATENT DOCUMENTS

| | | | |
|---|---|---|---|
| 2915001 | 10/1979 | Fed. Rep. of Germany | 362/61 |

*Primary Examiner*—James C. Yeung
*Attorney, Agent, or Firm*—Max Fogiel

[57] ABSTRACT

The invention concerns a headlight for motor vehicles, with a cover plate that covers up the reflector. An essentially U-shaped enclosure made out of sheet metal is positioned in the vicinity of the lamp, which fits into an opening in the vertex of the reflector. The flanks of the enclosure extend above and below but not in contact with the lamp, at least to some extent constituting a screen that screens off sections of the reflector that generate diffused light. The flank below the lamp also functions essentially as a supporting arm for the enclosure. The free terminal section of the supporting arm above the lamp has a third screen. A tongue is punched and bent out of the area of the U-shaped enclosure between the lamp and the cover plate and constitutes the upper supporting arm.

11 Claims, 3 Drawing Figures

HEADLIGHT FOR MOTOR VEHICLES

BACKGROUND OF THE INVENTION

The invention concerns a headlight for motor vehicles, with a cover plate that covers up the reflector, with an incandescent lamp that fits into an opening in the vertex of the reflector, and with an essentially U-shaped enclosure made out of sheet metal and positioned in the vicinity of the lamp, the flanks of the enclosure being connected by a web between the bulb and the cover plate with one of them, which extends, once the headlight has been assembled, above and below but not in contact with the lamp, at least to some extent constituting a screen that screens off sections of the reflector that generate diffused light, whereby the flank below the lamp functions essentially as a supporting arm for the enclosure and whereby the free terminal section of the flank above the lamp screens off the socket and/or the base of the lamp and/or the areas of the reflector adjacent to the vertical opening from the light emitted by the lamp.

FIG. 1 illustrates an enclosure of this type for headlights. The essentially U-shaped enclosure is made out of a cup-shaped sheet of metal. The web that constitutes the base of the U has a perforation punched out of it, and the two flanks of the U, which function as opposing supporting arms, are punched out of the walls that constitute the surface. The sections of the flanks in the vicinity of the web are wide enough to function as screens. The free terminal section of the flank above the lamp has another screen that screens off not only the areas of the reflector adjacent to the vertical opening from the diffused light that occurs at the bottom of the lamp but also the upper edge of the socket from the rays directly emitted from the filament. The flank above the lamp can also function as a supporting arm because its terminal end has, in addition to the screen, two punched-out tongues that fit into slots in the base of the lamp. The heat conducted through the flank that functions as a supporting arm can heat not only the base but also the socket up to or even beyond a critical temperature range, especially if they are made out of a material that does not resist heat. To allow the heat in the flank of an enclosure of this type, with the free terminal section of the flank above its lamp having a screen in the vicinity of the socket, to be diverted through the supporting arm into a section of the reflector that is far enough away from the socket and base, a supporting arm made out of another strip of sheet metal must be secured with one end resting against the area above the filament and the other against the reflector. Securing an additional supporting arm to the flank on an industrial scale, however, is too difficult and, because of excessive investment costs, too expensive.

SUMMARY OF THE INVENTION

The object of the invention is to design a U-shaped sheet-metal enclosure for a motor-vehicle headlight of the aforesaid generic type such that the upper supporting arm in the vicinity of the web of the U can be manufactured in one piece with the flank of the U above the lamp and such that the free end of the arm can be secured to the reflector remote from the vertex in order to divert heat through the arm into a section of the reflector that is far enough away from the socket and base. The supporting arm is also intended to extend within the shadow cast by the flank above the lamp to prevent screening off any more of the reflecting surface of the reflector. The object is attained in accordance with the invention in that a tongue is punched and bent out of the area of the U-shaped enclosure between the lamp and the cover plate and constitutes the upper supporting arm that can be secured to the reflector. This measure is very simple and can be carried out very cost-effectively.

It is also practical for the incision that creates the tongue that constitutes the supporting arm to extend along the total height of the web and into the flank or flanks. This measure makes it possible to vary the length of the supporting arm so that the enclosure can be employed in different-size reflectors just by extending the incision.

Another advantage is obtained when the width of the perforation created by punching and bending out the tongue that constitutes the supporting arm extends into the vicinity of the lateral edges of the web. This measure allows the extremely hot air above the lamp to escape effectively through the opening and rise.

It is also an advantage for the strip of the web, which is narrowed by the increased width of the perforation, to have a bowed cross-section. This will provide sufficient rigidity to the narrow strip of web.

It is also practical for the outer end of the bulb, where the light emerges, to have an opaque cap to screen off the cover plate from the rays emitted directly from the incandescent lamp. The cap prevents the rays from penetrating the perforation in the center of the enclosure and occasioning glare.

It is also practical for the enclosure to be bent out of a flat blank of sheet metal. An enclosure of this type can be manufactured with a relatively simple tool.

The free ends of the supporting arms in one practical embodiment of the invention snap into an opening in the reflector. This makes the enclosure rapid and easy to mount.

In another embodiment of the invention tongues are punched out of the free ends of the supporting arms and inserted, up to shoulders in the supporting arms that constitute a seat for them, into slots in the reflector with the free terminal section bent around the bottom of the reflector. This ensures a secure seating of the enclosure against the reflector.

Another advantage is obtained in that the free terminal section of the supporting arm below the bulb is bent in toward the bottom of the reflector. This measure diverts the heat in this arm as well from the enclosure into a section of the reflector that is far enough away from the socket and base.

DESCRIPTION OF THE PREFERRED EMBODIMENTS

Figure 1:
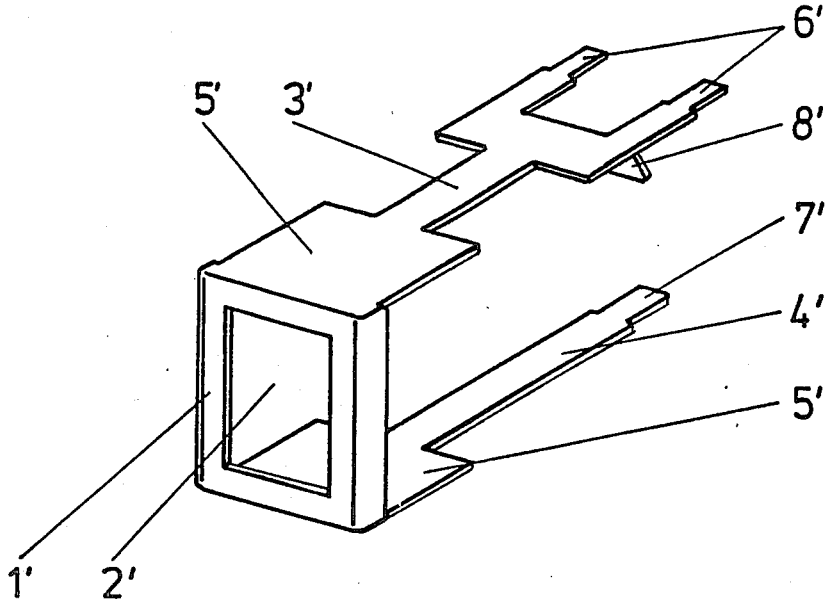
FIG. 1 is a perspective view of an embodiment of an enclosure for a motor-vehicle headlight that is the point of departure for the invention.
Figure 3:
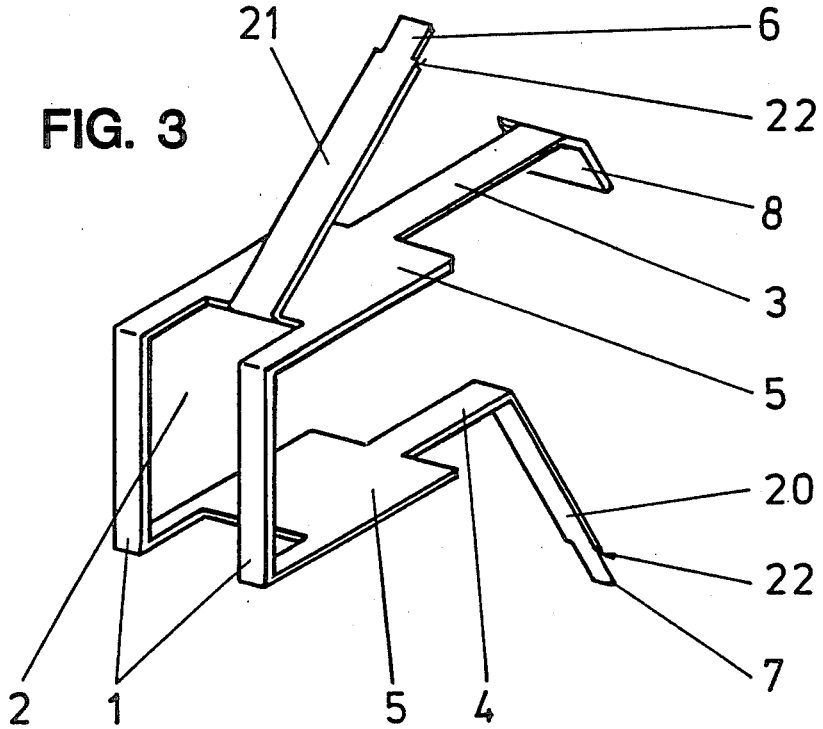
FIG. 3 a perspective view of the enclosure illustrated in FIG. 2.

FIG. 1 shows a known, essentially U-shaped enclosure for an unillustrated motor-vehicle headlight. The enclosure is made out of a deep-drawn cup-shaped piece of sheet metal. Stamped out of its rectangular base 1', which constitutes the web, is a perforation 2'. Also stamped out of the walls that constitute its surface are two opposing flanks 3' and 4' that function as supporting arms. The flanks 3' and 4' that function as supporting arms also have, adjacent to base 1', screens 5' that, when the reflector has a rectangular light-emission aperture, screen off its upper and lower straight sections from rays emitted directly from the filaments. Punched out of the free terminal section of flank 3' are two tongues 6'. Also punched out of flank 4' is a tongue 7'. Tongues 6' and 7' can be secured in slots in the base of a lamp. Between tongues 6' flank 3' has an additional screen 8', bent down toward flank 4', which screens off the areas of the reflector adjacent to the vertical opening from the diffused light that occurs at the bottom of the lamp. Screen 8' also screens off the upper edge of the socket from the rays directly emitted from the filament.

Figure 2:
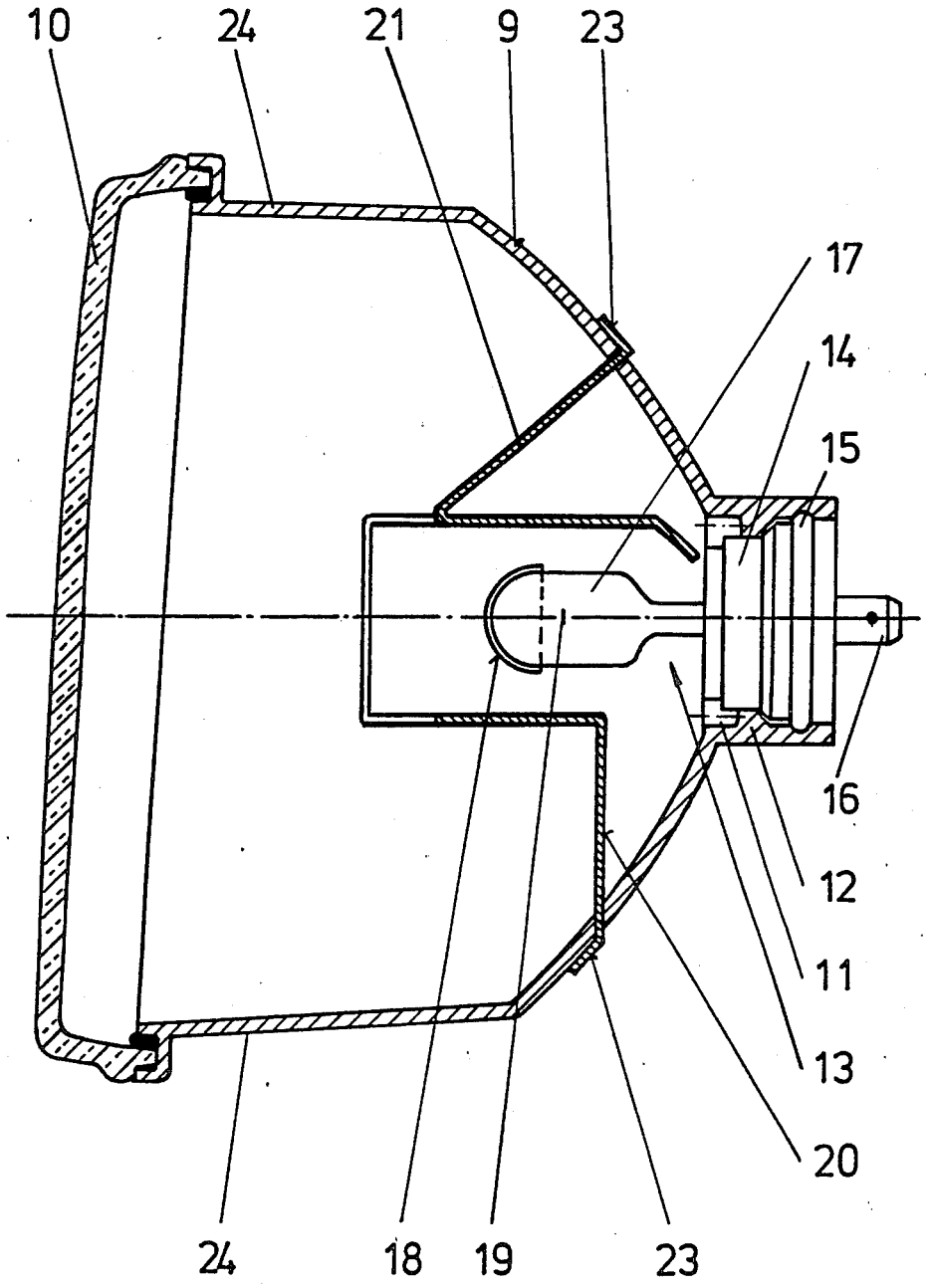
FIG. 2 is a longitudinal section through a headlight with an enclosure.

FIG. 2 illustrates a motor-vehicle headlight in accordance with the invention. Its reflector 9 has a rectangular light-emission aperture covered by a cover plate 10. The continuous outer edge of cover plate 10 is cemented to the edge of the reflector. Reflector 9 is made out of a material, plastic for instance, that is not very resistant to heat. A vertical opening 11 on the rear of reflector 9 is surrounded by the neck 12 of the reflector. An incandescent lamp 13 with a socket 14 in the form of a plastic sleeve is inserted in neck 12 from the rear of reflector 9. A rubber ring 15 on the surface of socket 14 engages a groove that extends around the inside of neck 12 and secures socket 14 axially. Sleeve-shaped socket 14 is secured radially by neck 12, at least some sections of which rest against its surface. The lamp's tab connectors 16 are secured to the surface of socket 14 that faces the rear of the reflector.

The outer end of the lamp's glass bulb 17, which is oriented toward cover plate 10, is covered by an opaque cap 18, screening off from the cover plate the rays of light emitted directly from filament 19.

Inside the headlight and in the vicinity of incandescent lamp 13 is an essentially U-shaped enclosure. The enclosure is bent out of a flat blank of sheet metal. The web 1 of the U extends perpendicular between incandescent lamp 13 and cover plate 10. The flanks 3 and 4 of the U extend above and below the lamp's glass bulb 17 without contacting it. The terminal section 20 of the flank 4 below bulb 17 is bent down toward the bottom of the reflector. Flank 4 functions as a supporting arm for the enclosure. A tongue 21 is punched out of the section of the U-shaped enclosure between bulb 17 and cover plate 10 and bent up toward the top of the reflector, with the incision extending over the total height of the web into flanks 3 and 4. Tongue 21, which functions as an additional supporting arm, extends within the shadow of flank 3.

Stamped out of the free terminal sections of supporting arms 3 and 4 of the enclosure above and below bulb 17 are tongues 6 and 7 that are inserted up to shoulders 22 that constitute a seat into slots in reflector 9. The terminal sections 23 that project through the slots are bent around the bottom of reflector 9 to secure the arms to it. The perforation 2 left by punching and bending out the tongue 21 that constitutes the supporting arm extends so far in width toward the lateral edges of the U that the strips of web 1 that demarcate the sides of the perforation are relatively narrow. The cross-section of the strips is in the shape of a bow. Adjacent to perforation 2 the flanks 3 and 4 above and below incandescent lamp 13 have a screen 5 that screens off the rays of light emitted directly from filament 19 from the light-diffusing straight sections 24 of reflector 9, which has a rectangular light-emission surface. The free terminal section of the flank 3 above bulb 17 has a third screen 8, bent toward the optical axis and screening off the upper edge of plastic socket 14 from the rays directly emitted from filament 19 and the areas of reflector 9 adjacent to vertical opening 11 from the diffused light that occurs at the bottom of bulb 17.

We claim:

1. A headlight for motor vehicles comprising: a reflector with a vertex and an opening in said vertex; a cover plate covering said reflector; an incandescent lamp fitting in said opening in said vertex; a substantially U-shaped enclosure comprised of sheet metal and positioned in vicinity of said lamp; flanks on said enclosure; a web between said lamp and said cover plate for connecting said flanks, said flanks extending above and below said lamp without contacting said lamp after assembly of said headlight; sections on said reflector generating diffused light, one flank comprising a screen for screening off said sections of said reflector; one of said flanks being positioned below said lamp and comprising substantially a supporting arm for said enclosure; another one of said flanks being positioned above said lamp and having a free terminal section; a base on said lamp screened off by said free terminal section; a tongue punched and bent out of an area of said U-shaped enclosure between said lamp and said cover plate, said tongue comprising an upper supporting arm securable to said reflector.

2. A headlight as defined in claim 1, wherein said tongue is punched from a cutout extending along the web's total height and into at least one flank.

3. A headlight as defined in claim 2, wherein said cutout extends into vicinity of lateral edges of said web.

4. A headlight as defined in claim 3, wherein said web comprises a strip of sheet metal narrowed by increased width of said cutout and having a bowed cross-section.

5. A headlight as defined in claim 1, wherein said lamp has an outer end where light emerges; an opaque cap on said outer end of said lamp to screen off said cover plate from rays emitted directly from said incandescent lamp.

6. A headlight as defined in claim 1, wherein said enclosure is bent out of a flat blank of sheet metal.

7. A headlight as defined in claim 1, wherein said supporting arms have free ends snapping into said opening of said reflector.

8. A headlight as defined in claim 1, wherein said supporting arms have free ends inserted into slots in said reflector; shoulders on said free ends of said supporting arms to comprise seats for said supporting arms when said free ends are inserted into said slots in said reflector; free terminal sections on said free ends of said supporting arms and bent around a bottom portion of said reflector.

9. A headlight as defined in claim 1, wherein one of said supporting arms is positioned below said lamp and has a free terminal section bent toward a bottom portion of said reflector.

10. A headlight as defined in claim 1, wherein said free terminal section of said flank above said lamp screens off also areas of said reflector adjacent to a vertical opening from light emitted by said lamp.

11. A headlight for motor vehicles comprising: a reflector with a vertex and an opening in said vertex; a cover plate covering said reflector; an incandescent lamp fitting in said opening in said vertex; a substantially U-shaped enclosure comprised of sheet metal and positioned in vicinity of said lamp; flanks on said enclosure; a web between said lamp and said cover plate for connecting said flanks, said flanks extending above and below said lamp without contacting said lamp after assembly of said headlight; sections on said reflector generating diffused light, one flank comprising a screen for screening off said sections of said reflector; one of said flanks being positioned below said lamp and comprising substantially a supporting arm for said enclosure; another one of said flanks being positioned above said lamp and having a free terminal section; said reflector having areas adjacent to a vertical opening, said free terminal section screening off said areas from light emitted by said lamp; a tongue punched and bent out of an area of said U-shaped enclosure between said lamp and said cover plate, said tongue comprising an upper supporting arm securable to said reflector.

* * * * *